US005279196A

United States Patent [19]

Mohr

[11] Patent Number: 5,279,196

[45] Date of Patent: Jan. 18, 1994

[54] APPARATUS FOR CUTTING STACKED, SHEET-LIKE MATERIAL

[76] Inventor: Wolfgang Mohr, Hundshager Weg 42, D-6238 Hofheim/Taunus, Fed. Rep. of Germany

[21] Appl. No.: 656,077

[22] PCT Filed: Apr. 25, 1990

[86] PCT No.: PCT/DE90/00301

§ 371 Date: Mar. 1, 1991

§ 102(e) Date: Mar. 1, 1991

[87] PCT Pub. No.: WO91/00168

PCT Pub. Date: Jan. 10, 1991

[30] Foreign Application Priority Data

Jul. 4, 1989 [DE] Fed. Rep. of Germany ..... 921886

[51] Int. Cl.[5] ..... B26D 7/01; B26D 7/18

[52] U.S. Cl. ..... 83/91; 83/159; 83/934; 414/907

[58] Field of Search ..... 83/84, 86, 89, 90, 91, 83/93, 102, 112, 157, 160, 163, 166, 934; 414/907

[56] References Cited

U.S. PATENT DOCUMENTS 3,165,956 1/1965 Thumim ..... 83/155
3,732,766 5/1973 McCain et al. ..... 83/157
4,445,409 5/1984 Mohr et al. ..... 83/157
4,850,257 7/1989 Mohr ..... 83/93

FOREIGN PATENT DOCUMENTS 8101462 1/1981 Fed. Rep. of Germany .
3921884 7/1990 Fed. Rep. of Germany ..... 83/86

*Primary Examiner*—Hien H. Phan
*Attorney, Agent, or Firm*—Michael L. Dunn; Robert P. Simpson

[57] ABSTRACT

An apparatus for cutting stacked sheet-like material has a table surface which includes an entry zone for receiving the material to be cut, a working zone above which a cutting blade and press beam are located, as well as an exit zone for receiving the material after it is cut. The exit zone comprises a first zonal area adjacent to the working zone and a second zonal area adjacent to the first zonal area, and a first straightedge arranged below the exit zone in the area of a parting surface of the two zonal areas. The second zonal area can be lifted from an initial position where it forms a plane with the first zonal area and the first straightedge can be lifted and moved into a working position with the first zonal area. The exit zone can be moved as a whole perpendicular to the cutting plane to form a gap between the exit zone and the working zone. When the second zonal area is lowered, the material to be cut is cut into individual strips, and the individual block strips can be cut up into individual blocks when the second zonal area is lifted and the first straightedge is in the working position. A transverse channel can be formed between the first straightedge and a second straightedge through which the individual blocks can be fed to a further processing station by means of an ejector.

32 Claims, 13 Drawing Sheets

View B

APPARATUS FOR CUTTING STACKED, SHEET-LIKE MATERIAL

Figure 1:
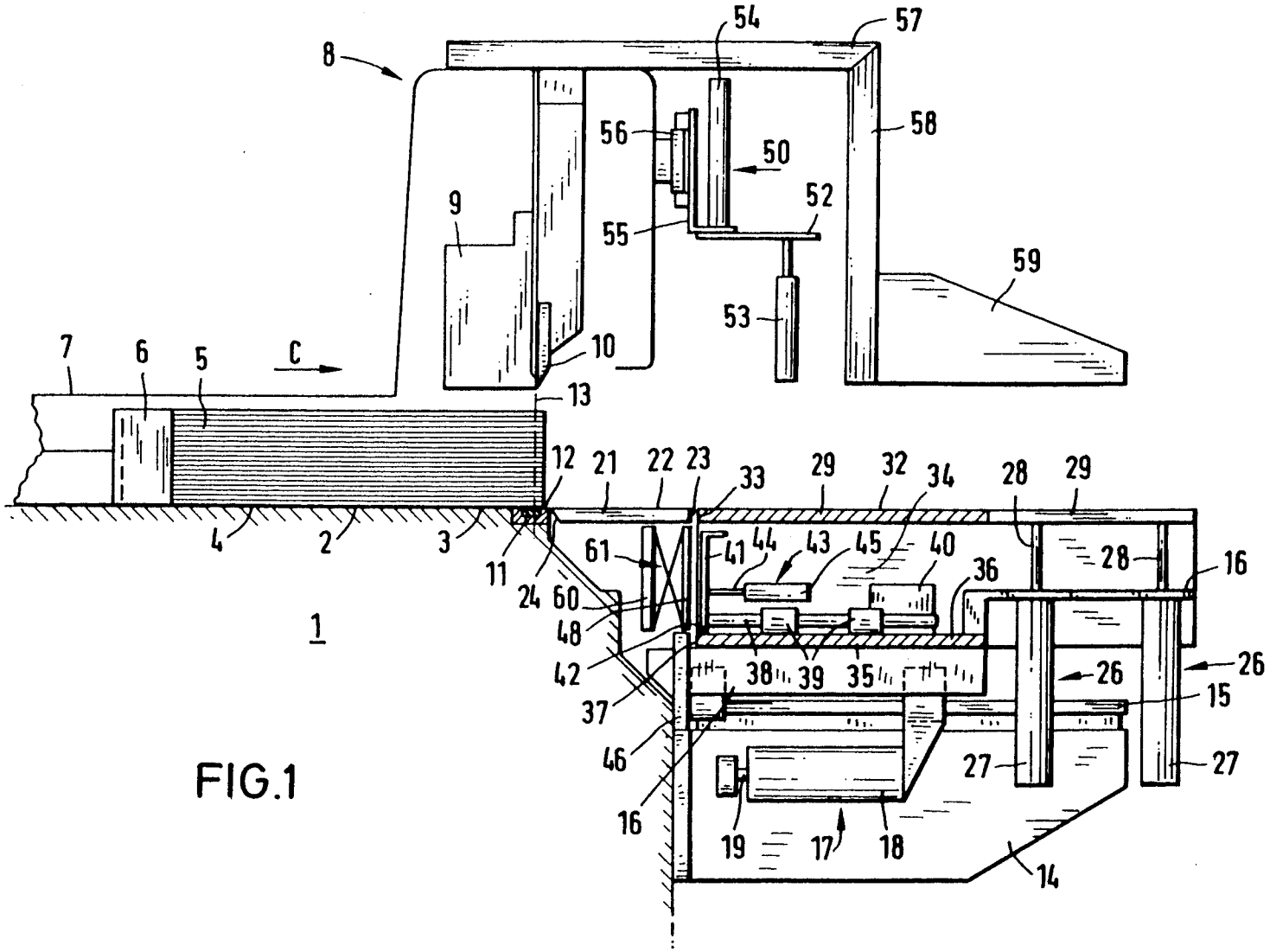

The invention relates to a apparatus for cutting stacked, sheet-like material, having a table surface which has a working zone, above which a cutting blade and a press beam are located, an entry zone behind it for receiving the material to be cut and an exit zone in front of it for receiving the cut material, and a feed device for the material to be cut, in which arrangement the exit zone is movable relative to the working zone while forming a gap, and a transverse channel leading to a further-processing station is provided on the exit zone, which transverse channel is formed by a first straightedge which can interact with the exit zone and can be brought into a working position and by a second straightedge which is located behind the first straightedge and can be brought into its working position after the gap is opened, and an ejector movable along the transverse channel is also provided.

DE No. 3,613,316 C1 discloses an apparatus of this type which is used as a second cutting apparatus of a cutting system in which a first cutting apparatus is designed for producing block strips by parallel longitudinal cuts, while the block strips are cut in the transverse direction by the second cutting apparatus so that individual blocks result. Efficient production is obtained through the use of two cutting apparatuses which are each designed for one function, namely, on the one hand, longitudinal cutting for producing the block strips and, on the other hand, transverse cutting of these block strips. In the known system, it is a disadvantage that two cutting apparatuses are required for cutting the block strips, which involves high system production costs.

The object of the present invention is to further develop an apparatus of the said type in such a way that, with this apparatus, that is, with a single cutting apparatus, both functions of longitudinal and transverse cutting of the block strips can be performed with minimum, manual effort and the cut blocks can be fed to the further-processing station in a simple manner In addition, the apparatus should also enable conventional cutting operations, that is, main, marginal and intermediate cuts, to be carried out The object is achieved according to the invention in that the exit zone is subdivided into a first zonal area adjacent to the working zone and a second zonal area arranged in front of the first zonal area, and the first straightedge is arranged below the exit zone in the area of the parting surface of the two zonal areas, in which arrangement the second zonal area can be lifted from the position forming a plane with the first zonal area, and the first straightedge can be lifted and moved into the working position with the first zonal area of the exit zone. Here, working position need not necessarily be understood as a defined position of the first straightedge; on the contrary, a plurality of positions of the straightedge with regard to the first zonal area of the exit zone are conceivable.

Through the design according to the invention of the exit zone having a first and second zonal area as well as a straightedge arranged below the exit zone, the desired different functions can be performed by the apparatus. Thus the apparatus, when the second zonal area is lowered, which in this position forms a plane with the first zonal area and a working zone as well as the entry zone, works in accordance with the apparatus described in European Patent No. 0,056,874. The first and second zonal area hereby form a unit movable in the feed direction of the material to be cut and in the opposite direction, with the means of creating a gap between this unit and the working zone for disposing of the shavings collecting during a marginal or intermediate cut. When the second straightedge is transferred into its working position after the gap is opened, this straightedge pushes the cut set, projecting beyond the first zonal area on account of the automatically set-back position of the cutting strip and the cutting blade, completely onto the exit zone so that it cannot be caught when the gap is closed again. In addition, the second straightedge ensures that the shavings are disposed of in a defined manner through the gap and are not flung onto the exit zone. The cut sets can be freely manipulated on the exit zone, and the second straightedge located in the working position additionally enables the set to be aligned at the same. In contrast hereto, the apparatus, when the second zonal area is lifted and the second straightedge is located in the working position, performs the function of the second cutting apparatus of the system described in DE No. 3,613,316 C1. Important here is the fact that the first straight-edge is moved to its working height at which it is located above the plane of the first zonal area, in particular terminates at the bottom at the plane of the first zonal area and therefore a set located on the first zonal area can be manipulated by this first straightedge. When the first straightedge has come into use, a transverse channel is formed by this first straightedge and a second straightedge, through which transverse channel the set or sets, for example of individual blocks of a block strip, can be fed to the further-processing station by means of the movable ejector. In accordance with the width of the sets, the width of the transverse channel can be changed by a corresponding adjusting movement of the first straightedge perpendicular to the cutting plane. Irrespective of this, it is of course still possible to carry out marginal and intermediate cuts after the actual sets are cut, the scrap again being disposed of through the gap formed between the first zonal area and the working zone, the second straightedge assuming the functions described above.

The first straightedge can be mounted in different ways, for example on the underside of the second zonal area or also on the upper side of a mounting part which is arranged parallel to and below the second zonal area, the first straightedge being arranged between the mounting part and the second zonal area. The second zonal area and the mounting part are conveniently connected to one another, in particular by lateral struts, so that they can be lifted and lowered together. So that a different width of the transverse channel can be formed, the second straightedge, irrespective of its mounting, should be arranged so as to be displaceable in the feed direction of the material to be cut and in the opposite direction. The assembly of the first straightedge in the mounting part for the second zonal area is regarded as the preferred embodiment, since in this case the mounting and mobility of this straightedge are simplest to effect. So that sets of different width can be processed, the first straightedge should if possible also be movable into the area of the first zonal area, in which case a transverse-channel width can be achieved only in the first zonal area up to such a width which extends over the first zonal area. In the case of the large transverse-channel width described last, it can be convenient when the mounting part forms a third zonal area of the exit zone, which third zonal area is arranged parallel to the second zonal area and can be lifted into the plane of the first zonal area. When the second zonal area is lifted, the set having a large width lies not only on the first zonal area but also on the third zonal area of the exit zone. In this embodiment, provision must be made for the clearance distance between the second zonal area, in concrete terms the underside of the component allocated to this zonal area, and the mounting part or the third zonal area of the exit zone to be greater than the maximum thickness of the cut material When the dimensions are determined in this way, the maximum transverse-channel width is defined by the first straightedge in its end position moved away from the first zonal area.

The area according to the invention of the apparatus is conveniently designed in such a way that a first table part is mounted in a base so as to be movable horizontally in the feed direction of the material to be cut and in the opposite direction, this table part accommodating the first zonal area of the exit zone, and the second table part being mounted in the first table part so as to be liftable and lowerable, which second table part accommodates the mounting part and the second zonal area, arranged parallel to one another, of the exit zone. The two table parts are conveniently moved via pneumatic or hydraulic power-transmission means. The second table part is advantageously mounted in vertical guides of the first table part, and lifting members for lifting and lowering the second table part act on a support for the second zonal area removable from the second table part and also on the first table part. If exclusively uniform sets are cut over a longer period with the apparatus according to the invention, which sets are fed to the further-processing station by means of the ejector, it is appropriate to design the second zonal area to be removable from the second table part, whereupon the cutting area and the area of the first straightedge can clearly be seen from the operating side and thus the cutting cycles can be monitored.

Particular embodiments of the apparatus relate to the arrangement and mobility of the two straightedges and in particular to the configuration of the second straightedge. Since the first straightedge, as a function of the width of the cut set, serves the purpose of forming a correspondingly wide transverse channel, it is necessary to arrange this straightedge to be movable in the feed direction of the material to be cut and in the opposite direction. Furthermore, this straightedge should be movable between an end position allocated to the first zonal area and an end position allocated to the mounting part and in its working position it should be essentially perpendicular to the table surface. In addition, the first straightedge is advantageously pivotable between two working positions, in which arrangement it is inclined in a first position essentially in accordance with the bevel of the cutting blade and in a second position is essentially perpendicular to the table surface. This correspondingly applies to the second straightedge, which in its working position should likewise be essentially perpendicular to the table surface. Furthermore, it is regarded as convenient when the second straightedge is arranged in its inoperative position under the first zonal area of the exit zone and can be moved through the gap into its working position, and in this position it should bear, over the entire length of the parting surface of working zone and first zonal area of the exit zone, against the rear edge of the first zonal area. The described design and arrangement of the second straightedge enables the shavings collecting during marginal or intermediate cuts to be disposed of effectively through the gap. Apart from this, the stationary limit of the transverse channel on one side of the same is formed by the second straightedge in its working position. So that the set can be pushed in both operating positions of the apparatuses, that is, when the second zonal area is lowered or the third mounting part is lifted, across onto the first zonal area of the working zone without the bottom sheet layers being caught, a movable supporting element should be provided which is located in front of the second straightedge and supports the material cut last, projecting beyond the rear edge of the first zonal area, at least at the level of the cut-material locating surface of this zonal area, the supporting element being moved back into the straightedge plane when the working position of a second straightedge is reached. In detail, the second straightedge can be provided with at least one supporting element, this supporting element having a top free end, and, during the closing horizontal transfer of the straightedge for reaching its working position, being swung from a first end position into a second end position in such a way that the free end of the supporting element, in the first end position swung out of the straightedge bearing surface in the direction of the exit zone, comes to lie below the plane formed by the cut-material locating surface of the zonal area and, in the second end position swung into the straightedge, comes to lie at least in the plane of the cut-material locating surface of the zonal area. In addition, the second straightedge, on its surface facing the material to be cut, can accommodate a lay straightedge which can be placed against this surface of the material to be cut It is also possible by means of this lay straightedge to align the side of the stacked, sheet-like material remote from the feed device, which material is resting on the working zone. It should be possible to place the lay straightedge against the material to be cut at least in the area of the top sheets of the same. This is because it has been found in practice that the top sheet layers in particular are pulled away from the feed unit after the material is pressed as required for a satisfactory cutting operation.

The cause can in all probability be seen in the fact that, when the material to be cut is pressed to a considerable extent, air pockets between the individual sheet layers are also pressed out, which leads to a height reduction in the stack to be cut in the area of the press beam and consequently, when the press beam is raised, leads to the top sheet layers being undesirably displaced well into the area of the cutting blade with the risk of subsequent faulty cuts.

Figure 2:
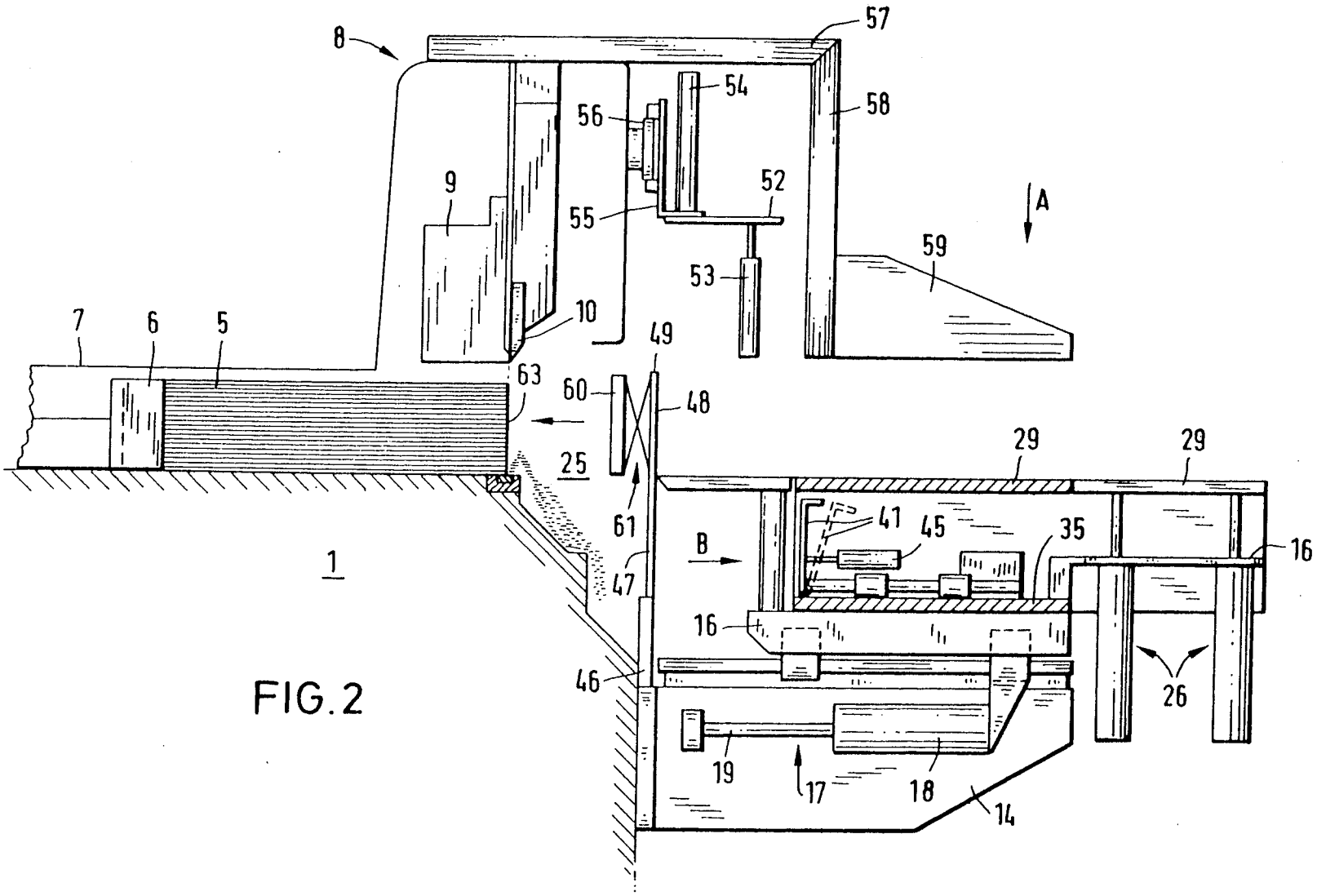
Figure 3:
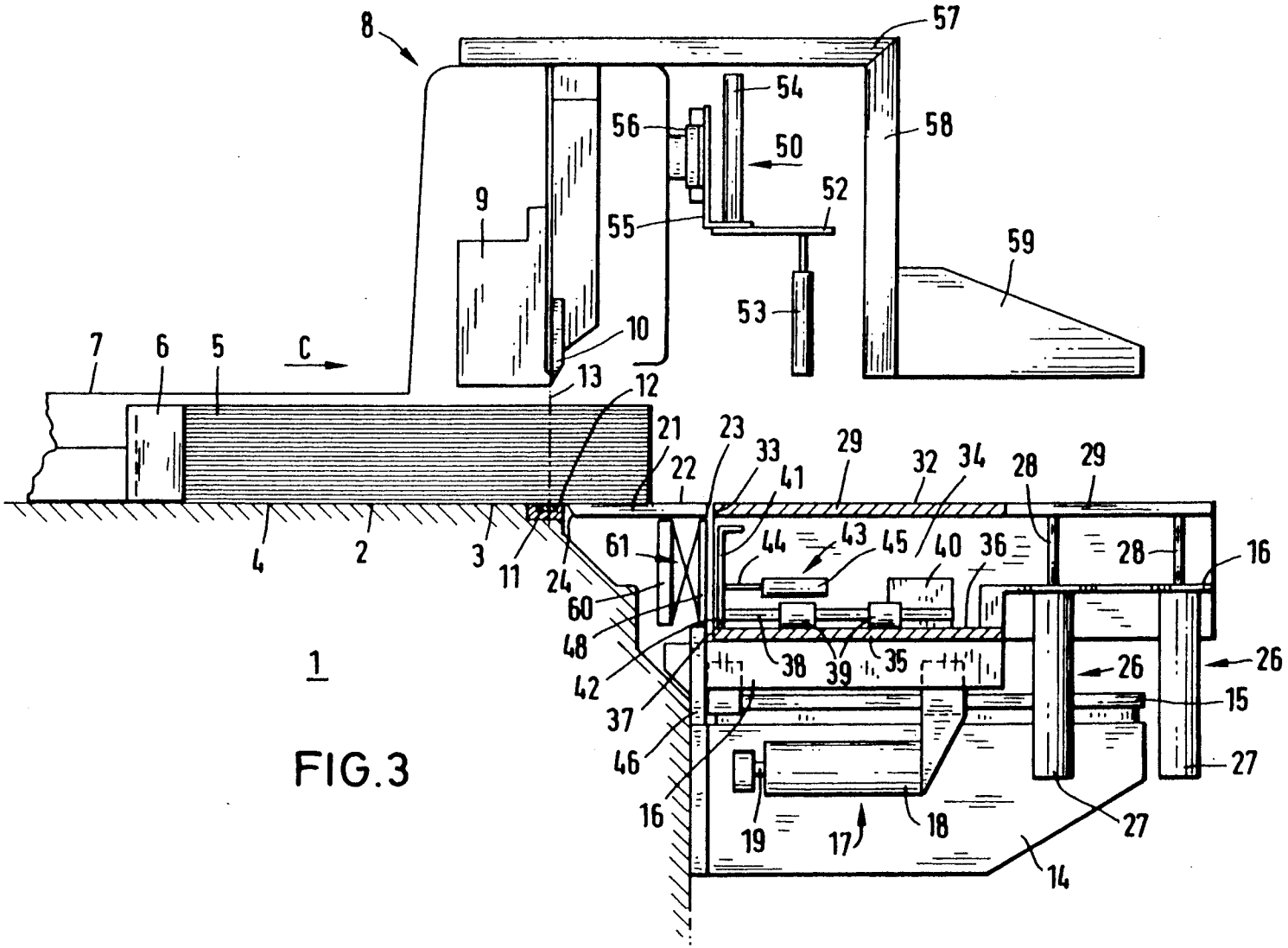
Figure 4:
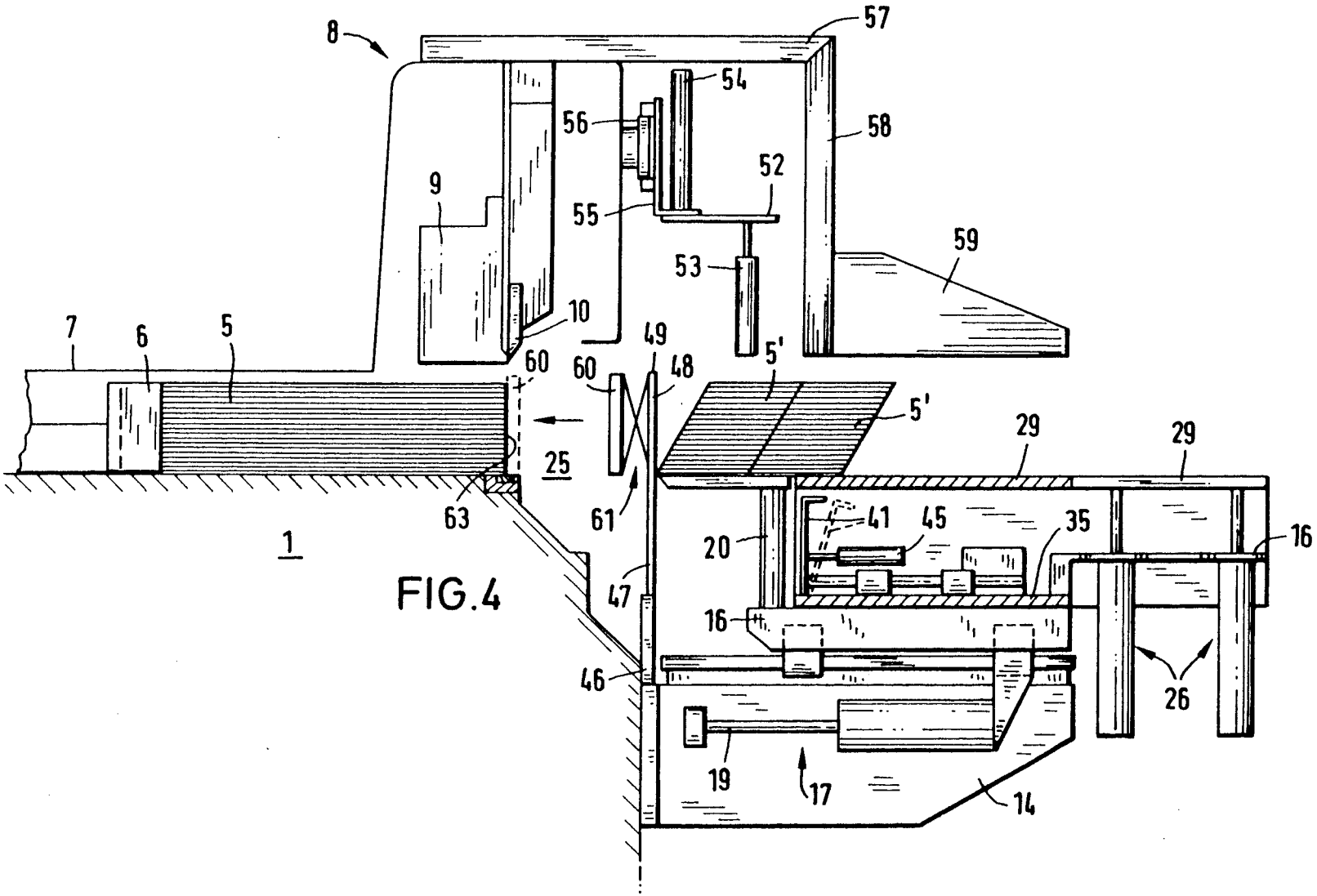
Figure 5:
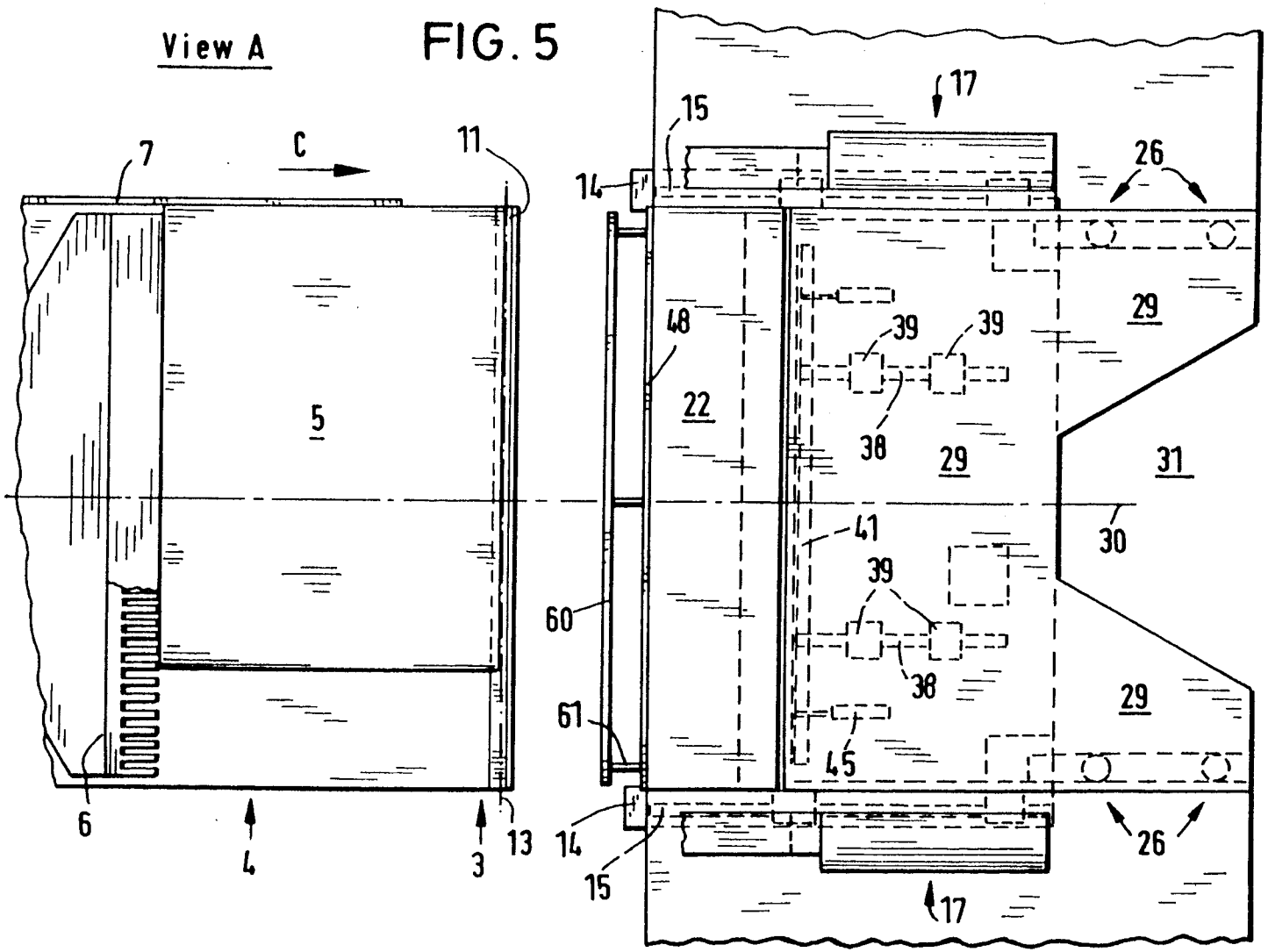
Figure 6:
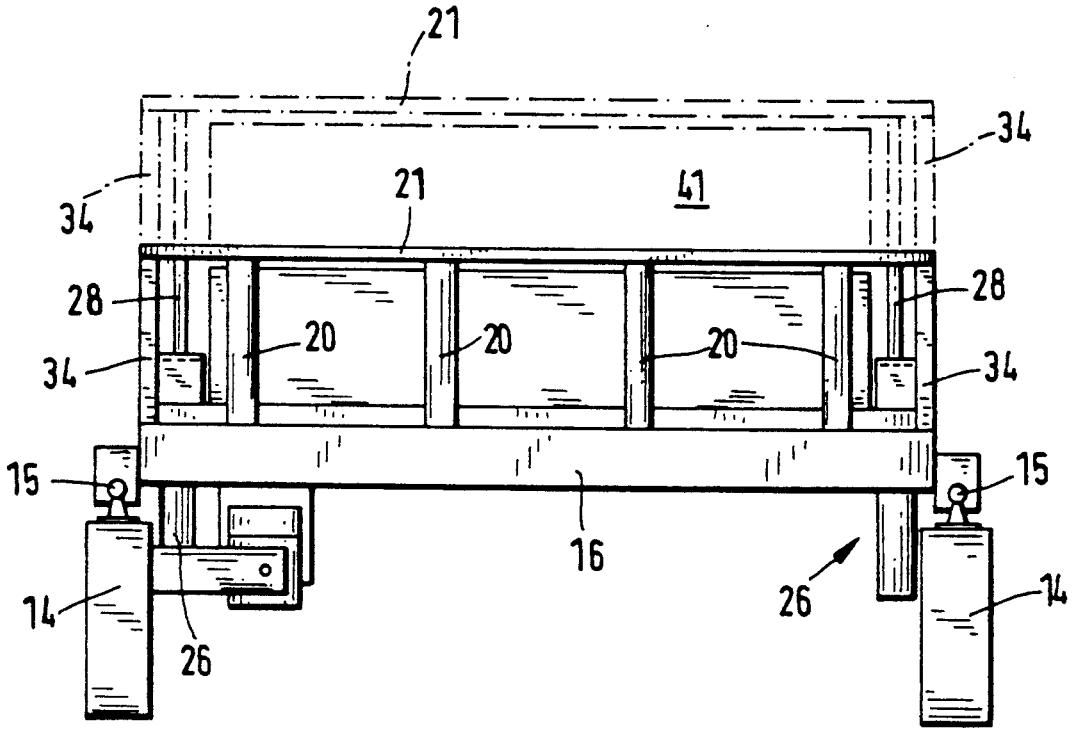
Figure 7:
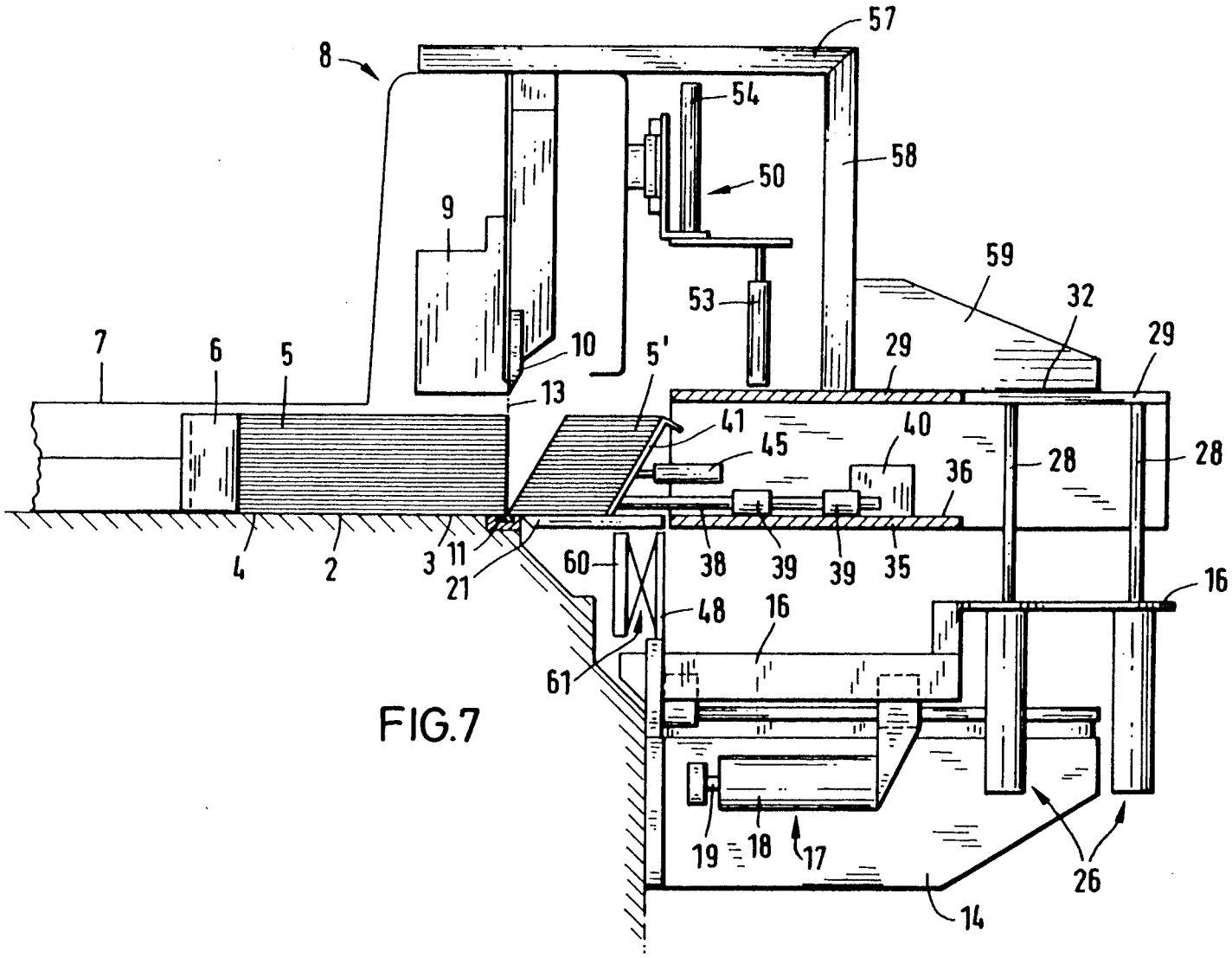
Figure 8:
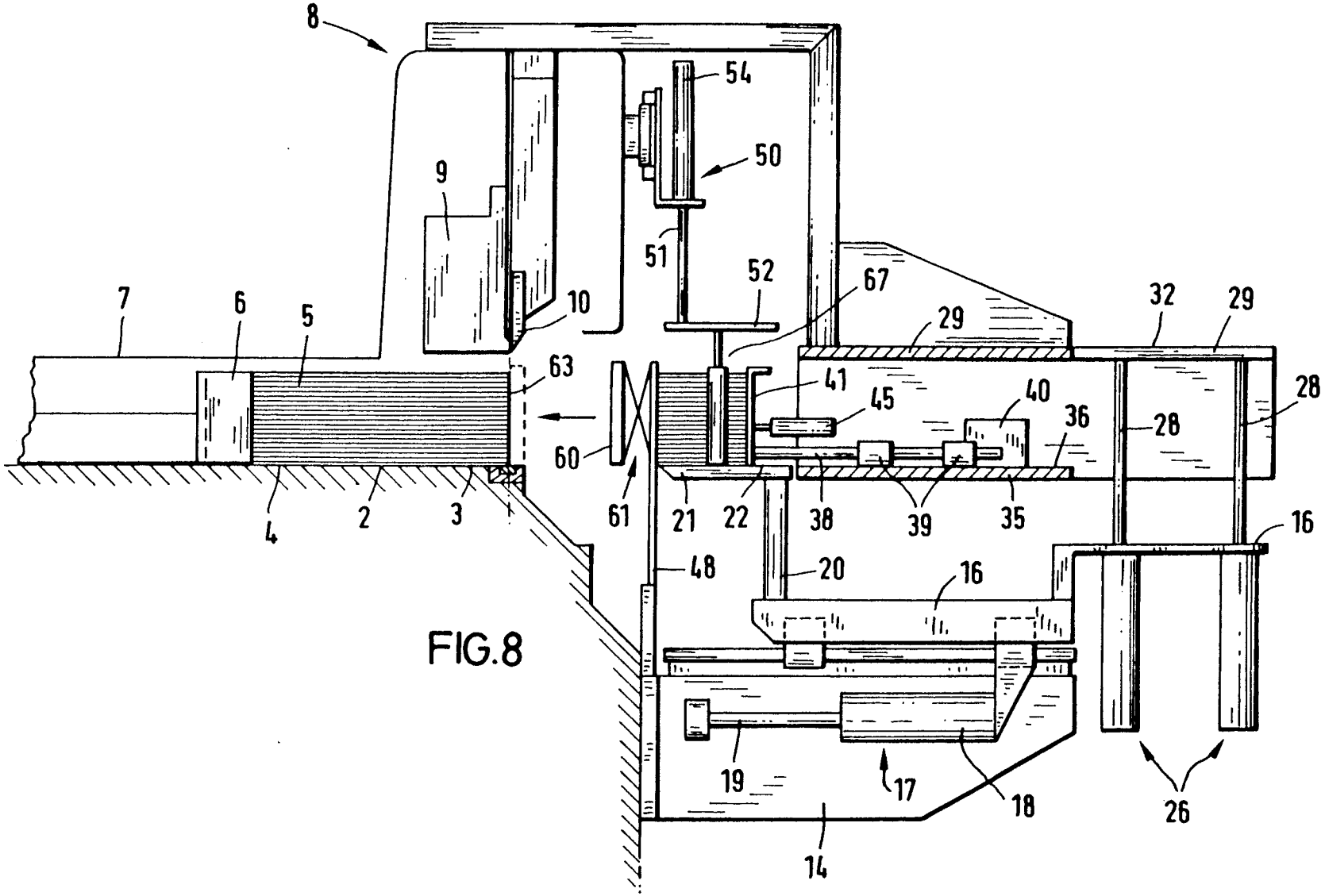
Figure 9:
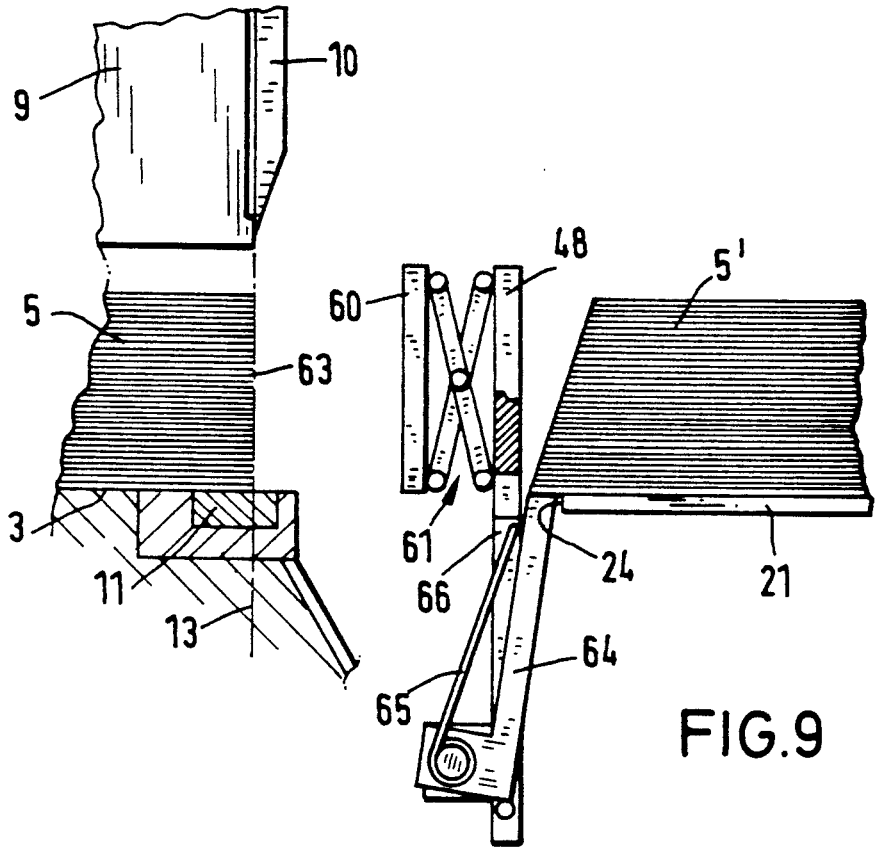
Figure 10:
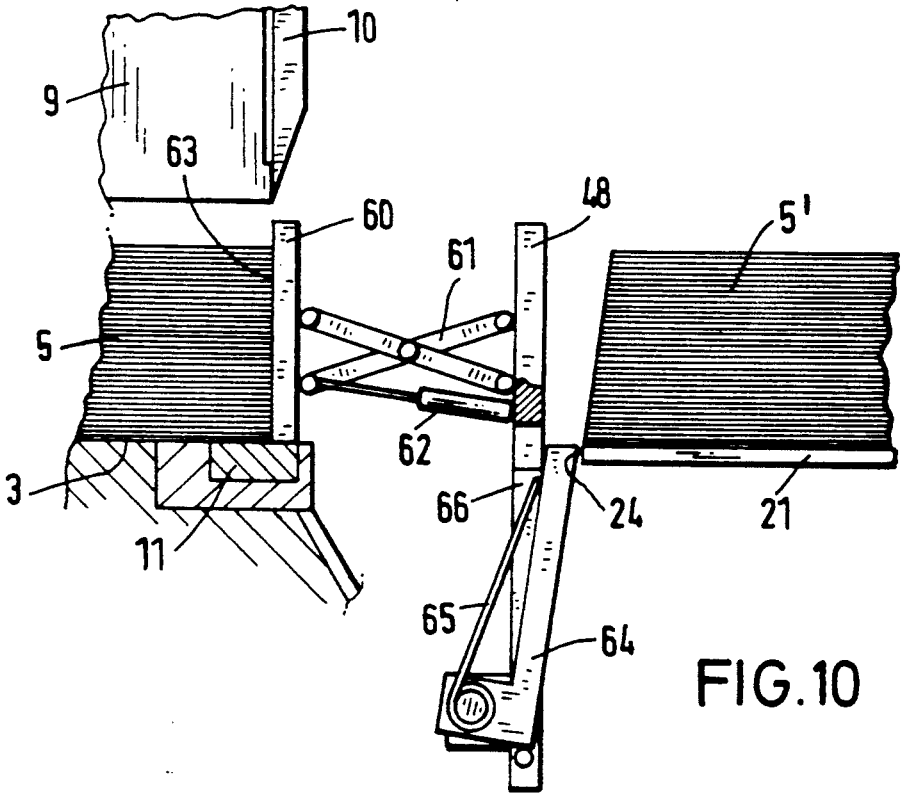
Figure 11:
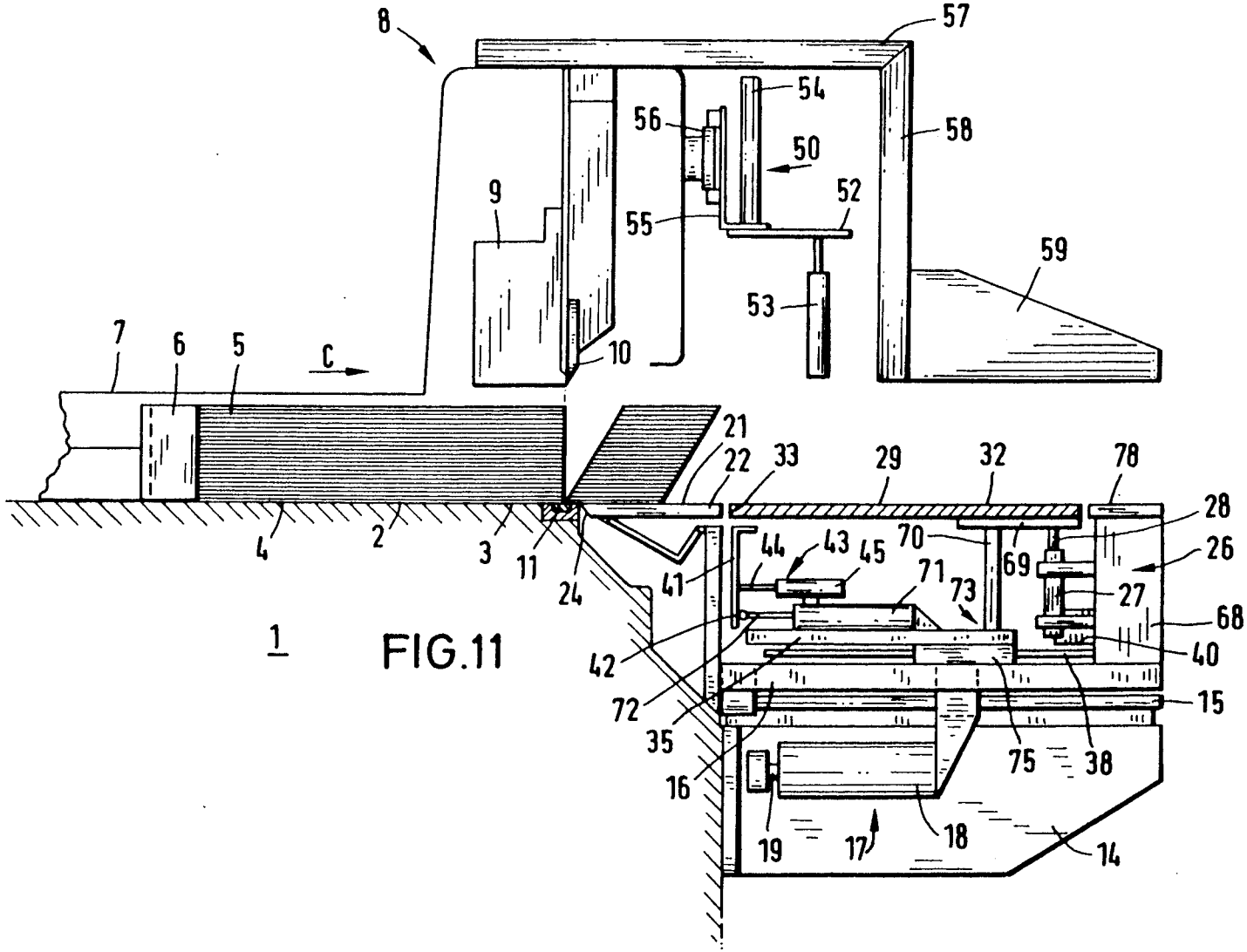
Figure 12:
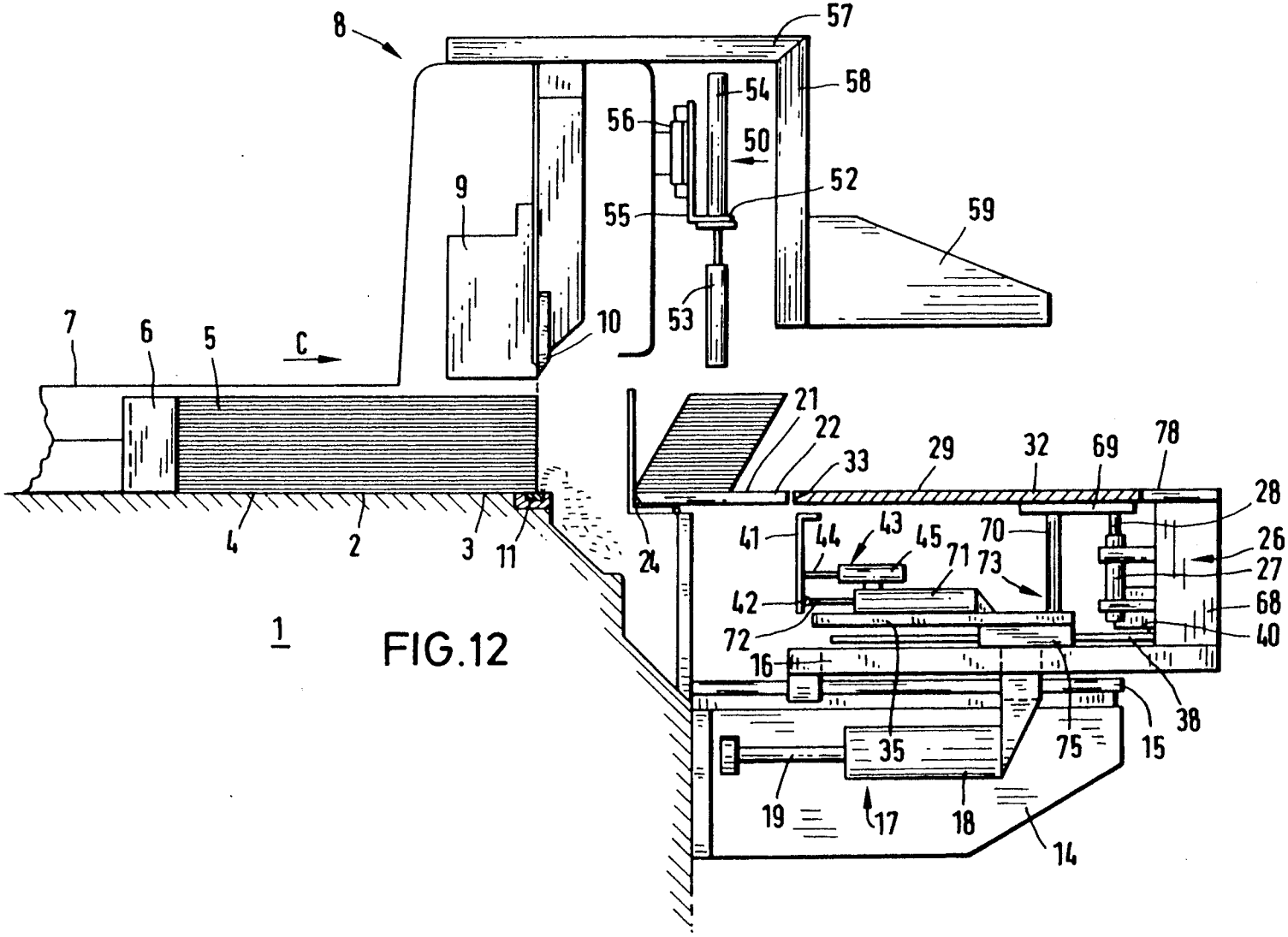
Figure 13:
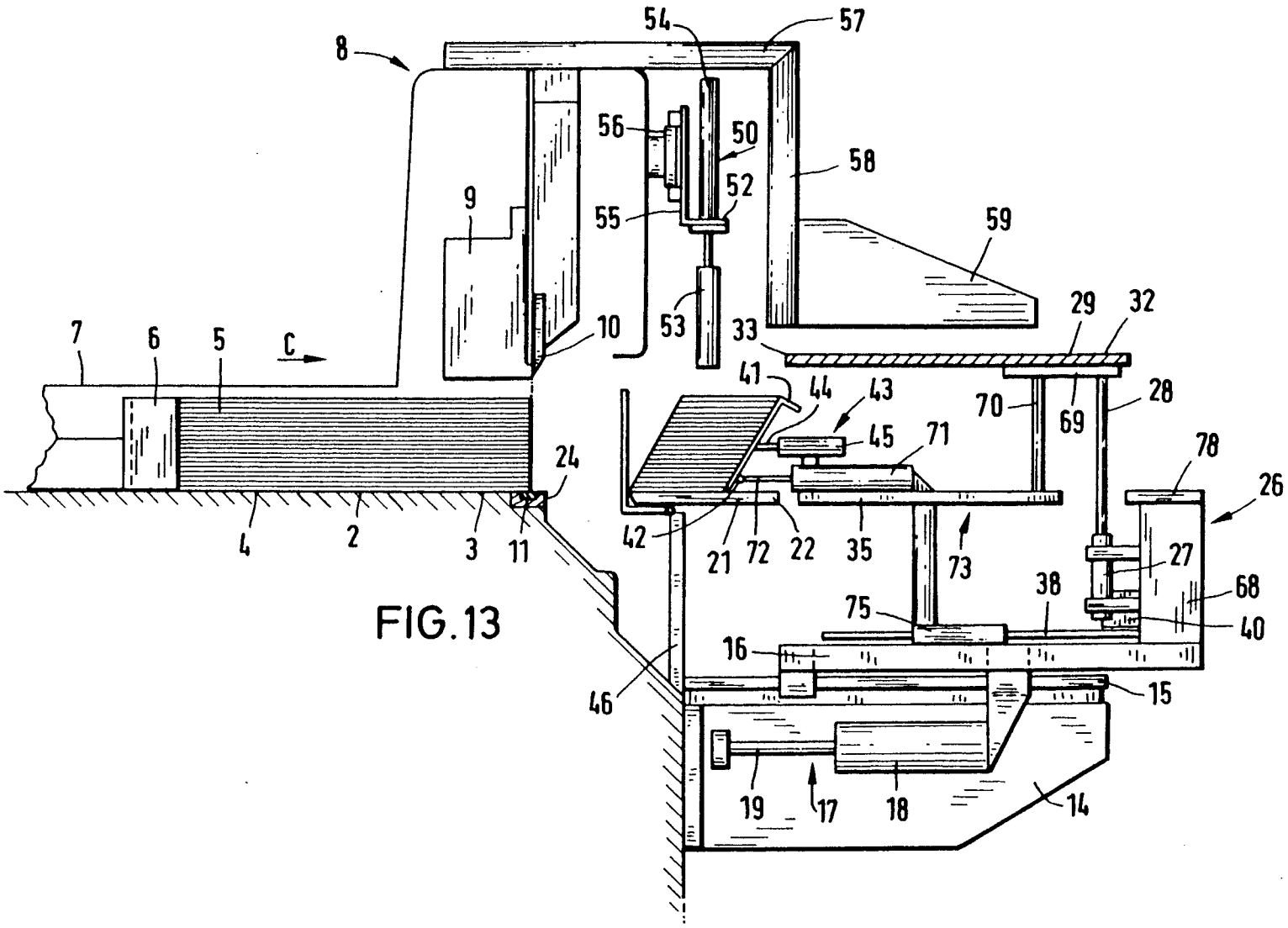
Figure 14:
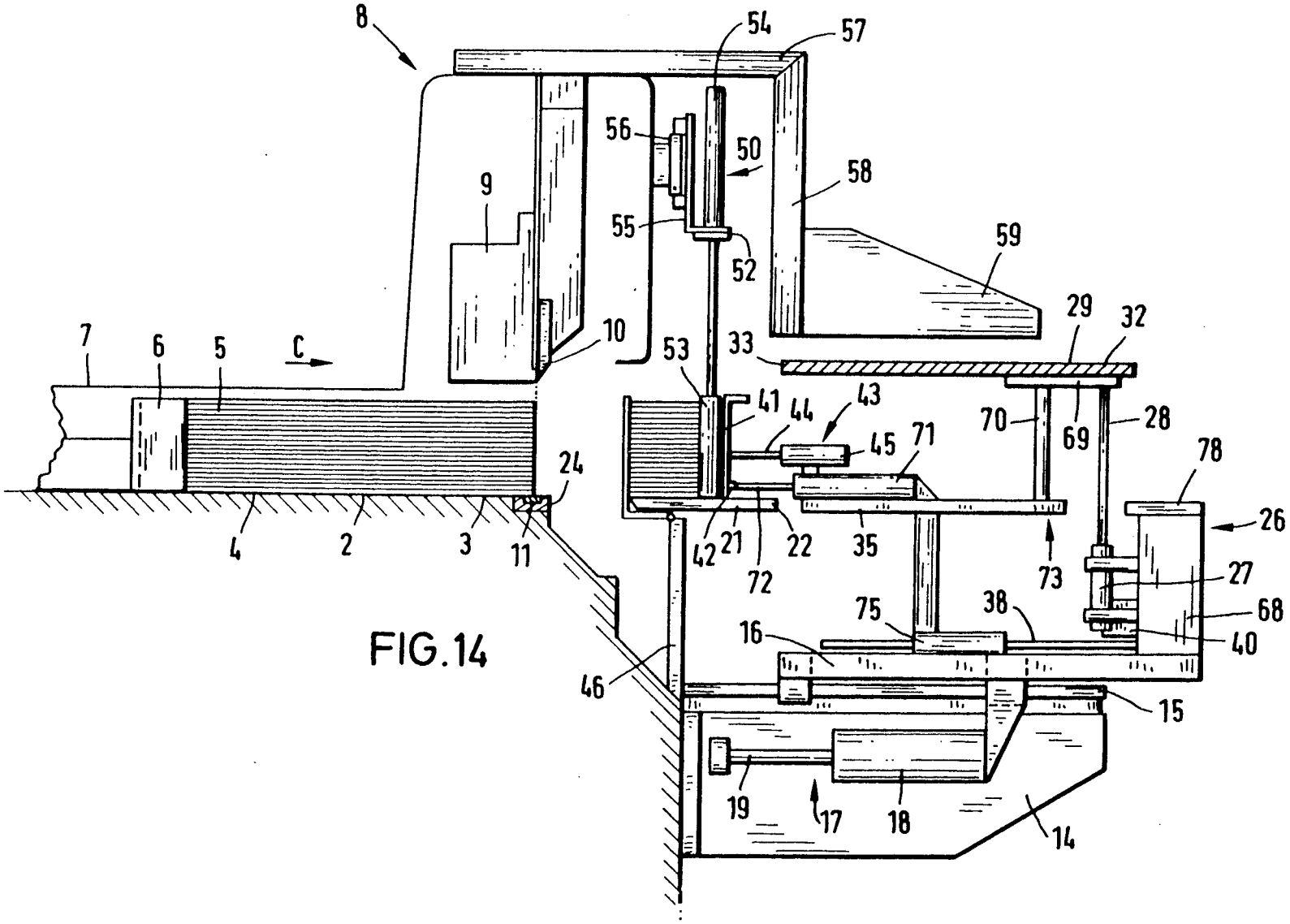

Further features of the invention are described with reference to the figures and in the subclaims, all individual features and all combinations of individual features being essential to the invention. The invention is schematically shown in the figures with reference to two embodiments without being restricted to these embodiments. In the drawing:

FIG. 1 shows a side view of a first embodiment of the apparatus according to the invention, in which the exit zone has a first zonal area, a second zonal area arranged in front thereof and a third zonal area arranged below the latter, when the first and second zonal area of the exit zone form a plane and the gap is closed, before a marginal cut, FIG. 2 shows a side view of the apparatus according to FIG. 1 after the marginal cut when the gap is open, FIG. 3 shows a side view of the apparatus according to FIG. 1 before the main cut, FIG. 4 shows a side view of the apparatus according to FIG. 1 after a plurality of main cuts when the gap is open and the second straightedge is extended, FIG. 5 shows a view of the apparatus according to arrow A in FIG. 2, FIG. 6 shows a view of the apparatus according to arrow B in FIG. 2, FIG. 7 shows a side view of the apparatus according to FIG. 1 when the first and third zonal area of the exit zone form a plane and the gap is closed, FIG. 8 shows a side view of the apparatus according to FIG. 7 when the gap is open and the first and second straightedge are located in working position, FIG. 9 shows a detailed view of a second straightedge before the sectional stack is pushed across onto the first zonal area of the exit zone, FIG. 10 shows a detailed view according to FIG. 9 after the push-across operation when the second straight-edge is moved in the direction of the working zone, FIG. 11 shows a side view of the apparatus according to a second embodiment, in which the exit zone has a first zonal area, a second zonal area located in front thereof and a mounting part located below the latter for accommodating the first straightedge, when the first and second zonal area of the exit zone form a plane and the gap is closed, after the main cut, FIG. 12 shows a side view according to FIG. 11 after the main cut, when the gap is open and the second straightedge is extended, following the subsequent intermediate cut, FIG. 13 shows a side view of the apparatus according to FIG. 11, when the mounting part and thus the first straightedge are lifted, after a main cut, when the gap is open and the second straightedge is located in the working position and the first straightedge is located in a first inclined working position, FIG. 14 shows a side view of the apparatus according to FIG. 13 when the first straightedge is moved into the second perpendicular working position and the ejector is lowered behind the set FIGS. 1, 5 and 6 illustrate the fundamental construction of the cutting apparatus which forms a construction unit and is designed in the form of a guillotine-type cutting machine On a stationary base 1, a working zone 3 is formed in the front area of its table surface 2 and an entry zone 4 is formed in its rear area. The entry zone serves to receive the material 5 to be cut, for example a sheet stack formed of individual sheet layers. The material 5 to be cut can be displaced in the feed direction according to arrow C by means of a feed device 6 designed as a saddle. The material 5 to be cut is aligned at one side at a side stop 7. A vertically movable press beam 9 and a likewise vertically movable cutting blade 10 are arranged above the working zone 3 in a frame part 8 connected to the base 1 and extending above the table surface 2. The cutting blade 10 interacts with a cutting strip 11 which is let into the table surface 2 of the base 1 and for static reasons is arranged so as to be set back slightly from the front edge 12 of the table surface 2. The cutting plane of the cutting blade 10 is illustrated by the reference numeral 13.

Connected to the base 1 are two supporting members 14 which likewise form a part of the base and are arranged in parallel at a distance from one another. In accordance with the horizontal arrangement of the table surface 2, the supporting members 14 have horizontal guiderails 15 in which a table part 16 is mounted so as to be movable in the feed direction C and in the opposite direction. To this end, each supporting member 14 has allocated to it a pneumatic cylinder 17 whose respective cylinder housing 18 is fastened to the underside of the first table part 16 and whose piston rod 19 is fastened to the respective supporting member 14

As additionally apparent from the representation in FIG. 6, the table part, in its rear area, that is, the area facing the base 1, has four mounting webs 20 connected to this area and directed upwards, to the top ends of which mounting webs 20 a horizontal table plate 21 is firmly connected. The latter extends over the same width of the apparatus as the table surface 2. The table surface of the table plate 21 is designated below as the first zonal area 22 of an exit zone for the cut material; it forms a plane with the table surface 2 of the entry zone 4 and working zone 3. The table plate 21 is connected in the area of its front end 23 to the mounting webs 20. When the piston rods 19 of the pneumatic cylinder 17 for horizontally moving the table part 16 are retracted, the table plate 21 bears with its rear end 24 against the front edge 12 of the table surface 2 of the base 1, whereas, when the piston rods 19 are extended, the table plate 21 is moved horizontally away from the base 1 and thus a gap 25 is formed between base 1 and table plate 21.

In the front area of the table part 16, which area is offset towards the top, two pneumatic cylinders 26 are arranged on each supporting-member side one behind the other as viewed in the feed direction C, the respective cylinder housing 27 of which pneumatic cylinders 26 is firmly connected to the table part 16 and their vertically movable piston rod 28 is connected to a table plate 29. The table plate 29 has a width corresponding to the width of the table plate 21, and it is likewise of rectangular design but is provided with a V-shaped recess 31 (shown in Figures) in the front area symmetric to the centre longitudinal axis 30 In the outer area of the recess 31, the four pneumatic cylinders 26 act in pairs on the underside of the table plate 29 When the piston rods 28 are retracted, the table surface of the table plate 29, which is designated below as the second zonal area 32 of the exit zone, forms a plane with the first zonal area 22 of the exit zone. The rear end 33 of the table plate 29 is arranged in direct proximity to the front end 23 of the table plate 21, that is, at the smallest possible distance from the front end 23.

A connecting plate 34 (shown in FIG. 6) is connected to the underside of the table plate 29 in the area of each outer side of the same; the two connecting plates 34 accommodate a further table plate 35 between them in the area of their bottom end. The width of the table plate 35 corresponds to the width of the table plate 29, but the table plate 35 is designed to be shorter than the table plate 29; the area which encloses the recess 31 is omitted there The vertical distance between the table plate 29 and 35 is greater than the maximum height of the material 5 to be cut. In the extended position of the piston rods 28 of the pneumatic cylinders 26, the table plate 35 is lifted to such an extent that its table surface, which is designated below as a third zonal area 36 of the exit zone, forms a plane with the first zonal area 22 of the exit zone. In this position, the rear end 37 of the table plate 35 is adjacent to the front end 23 of the first zonal area 22 of the exit zone.

In the area of each of its outer sides, the table plate 35 accommodates toothed racks 38 which are arranged parallel to one another, are movable in the feed direction C or in the opposite direction and can be driven in synchronism via a common drive 40 which is likewise mounted in the table plate 35 and has gears (not shown in more detail). The toothed racks are positioned parallel to and at a minimum distance from the table plate 35; in the area of their respective rear free end they pivotably accommodate a first straightedge 41 in the area of its bottom edge. At a distance from the pivot axis 42 of the first straightedge 41, a pneumatic cylinder 43 allocated to each toothed rack 38 acts with its piston rod 44 on the first straightedge 41 so that the latter can be moved from a first position oriented perpendicularly to the table plate 35 when piston rods 44 are extended into a position inclined at an acute angle in the feed direction C when piston rods 44 are retracted The cylinder housings 45 of the pneumatic cylinders 43 are mounted in such a manner (not shown in more detail) that they are moved together with the feed spindles 38 By means of the toothed racks 38, the first straightedge 41 can be moved in the feed direction C up to the two mountings 39 of the toothed racks 38, which mountings 39 are adjacent to the first straightedge 41, and in the opposite direction to feed direction C beyond the rear end 37 of the table plate 35, whereupon maximum strip formats which overlap both the first zonal area and partly the third zonal area can be processed.

A perpendicularly acting pneumatic cylinder 46 is fastened adjacent to the base 1 in each case to the two table parts 16, the piston rods 47 of the pneumatic cylinders 46 accommodating between them a likewise plate-shaped straightedge 48 designated below as the second straightedge. The vertically movable and vertically oriented straightedge 48 is here positioned in such a way that it can be moved past the rear end 24 of the table plate 21 at a slight distance when the gap 25 is open to the maximum extent. In the lifted position of the straightedge 48, its top edge 49 is located at least slightly above the uppermost sheet layer of the material 5 to be cut. The straightedge 48 has a length which corresponds to the width of the table plate 21.

Finally, a further, vertically acting pneumatic cylinder 50 is mounted in the frame part 8, the piston rod 51 of which pneumatic cylinder 50 is provided with a mounting web 52 which extends in the feed direction C and to whose underside an ejector 53 is fastened. The ejector 53 is positioned in such a way that it is located above the table plate 21 when the gap 25 is open to the maximum extent. When the piston rod 51 is retracted, the bottom edge of the ejector 53 is located at a level which is higher than the level of the uppermost sheet layer of the material 5 to be cut; when the piston rod 51 is extended, the ejector 53 rests on the table plate 21. The ejector 53 itself is designed as a bar-shaped part, and the bar length is greater than the maximum thickness of the material 5 to be cut. The cylinder housing 54 of the pneumatic cylinder 50 is mounted via a mounting element 55 in a horizontal guide 56 of the frame part 8 and can be moved perpendicularly to the feed direction via a horizontally acting pneumatic cylinder (not shown in more detail). On either side, the frame part 8 is provided at the top with supporting bars 57 directed towards the front and supporting bars 58 which act on the front end of these supporting bars 57, are directed downwards and in turn accommodate light-barrier arrangements 59 in their lower area. The zonal exit area allocated to this light-barrier arrangement 59 thus represents the operating side of the guillotine-type cutting machine, and the operator is in the area of the recess 31.

The mode of operation of the apparatus according to the invention is described below with reference to the figures.

When the table plate is lowered, during which the entry zone 4, the working zone 3, the first zonal area 22 of the exit zone and the second zonal area 32 of the exit zone form a plane, the apparatus works according to the apparatus described in European Patent No. 0,056,874. Therefore, marginal, intermediate and main cuts can be made with the apparatus in a known manner. FIG. 1 shows the apparatus before a marginal cut. By means of the feed device 6, the material 5 to be cut is fed beyond the cutting plane 13 by the thickness of the marginal cut to be made. Before the marginal cut is made, the table part 16 is moved away from the base 1 by activating the two pneumatic cylinders 17, and thus the gap 25 forms between the rear end 24 of the table plate 21 and the front plate 12 of the table surface 2. The second straightedge 48 is then moved into the extended position by activating the two pneumatic cylinders 46 so that, during the subsequent marginal cut, the possibly brittle material to be cut which is separated during this cut is not flung onto the table plates 21 and 29 but can be disposed of down through the gap 25 by passing there at this location, for example, onto a conveying belt. On the side facing the material 5 to be cut, the second straightedge 48 is provided at the top with a lay straightedge 60 which is mounted in the second straightedge 48 by means of two scissor-type devices 61 arranged at a distance apart. Allocated to each scissor-type device 61 is a pneumatic cylinder 62 (shown in FIG. 10) for opening and closing the scissor-type device 61 so that the lay straightedge 60 can thereby be moved towards the front face 63 of the material 5 to be cut. It is thus possible, after release of the press beam 9 following the cutting operation, to counteract displacements, in particular of the top sheet layers, by again bringing these sheet layers to bear against the feed device 6 (see FIGS. 9 and 10). After the trimming of all margins of the material to be cut, which until then appears as a block, the actual main cuts, during which the sets are obtained, as well as the respective intermediate cut between two main cuts are made. FIG. 3 illustrates the position of the material 5 to be cut before a main cut. The material 5 to be cut has been fed in the feed direction C by means of the feed device 6 until the position of the main cut is reached. After the block is cut through, a set, that is, the cut material 5', is present which is displaced within itself in a parallelogram shape on account of the wedge-shaped configuration of the cutting blade and which also still rests slightly on the table surface 2 on account of the arrangement of the cutting strip 11 in the table surface 2. When the gap 25 is opened for the purpose of an intermediate cut, the cut material 5' thus hangs slightly over the rear end 24 of the table plate 21 with the risk of this area of the cut material 5' being caught when the gap 25 is closed again. FIG. 9 illustrates that, after the gap 25 is open to the maximum extent, the second straightedge 48 moved into the lifted position reaches with a plate-shaped supporting element 64 beneath the overhanging area of the cut material 5'. The supporting element is pivotably mounted in the second straightedge 48 below the table plate 21 and can be swung into a recessed portion 66 in the second straightedge 48 against the force of a plurality of springs 65, of which only one is visible, so that the supporting element 64 forms a plane with the second straightedge 48. If, starting from the supporting position, shown in FIG. 9, of the supporting element 64, the table plate 21 is moved in the direction of the second straightedge 48 by the pneumatic cylinders 17 acting upon the table plate 16, this leads to the cut material 5' being pushed across completely onto the table plate 21. FIG. 4 illustrates the relationships following a second main cut: the second straightedge 48 is extended, and the set 5' cut last has been pushed completely onto the table plate 21 by a slight displacement of the table plate 21 in the direction of a closing movement and has thus pushed the set 5' cut first further onto the table plate 29. The lay straightedge 60 is then moved towards the front face of the material 5 to be cut; the position shown of a second straightedge 48 in the representation in FIG. 10 is intended to illustrate that it is also perfectly possible to provide additional horizontal mobility of the second straightedge 48, in particular in the direction of the material 5 to be cut. The material 5 to be cut is cut through in the cutting sequence of main cut, intermediate cut, main cut, intermediate cut, etc., until the material to be cut is completely cut.

If the cut material 5' present in block strips is to be cut up further into individual blocks, this can be effected in principle by the cut material 5' being aligned manually at the second straightedge 48 by means of a set angle, whereupon it has the shape of a rectangular block, and is then turned through 90° and then fed again to the working zone 3 now as material 5 to be cut. Then, by activating the pneumatic cylinders 26, the table plate 29 and thus also the table plate 35 are lifted into a position in which the table plate 35 forms a plane with the table plate 21. In this position, the working sequence concerning the cutting of the block strips into individual blocks takes place in accordance with that described in DE No. 3,613,316 C1: first of all the individual block strips are fed by the feed device 6 to a thickness desired for a first main cut. The first straightedge 41 is fed by means of the feed spindles 38 in a position inclined from the vertical towards the lower area of the material 5 to be cut; the situation shown in FIG. 7 results after the cut, in which situation the individual blocks are again displaced within themselves in a parallelogram shape and are supported by the first straightedge 41. Then, by activating the pneumatic cylinders 17, the table part 16 and thus the table plates 21 and 35 are jointly moved away from the base 1 while forming the gap 25. The second straightedge 48 is then extended and the first straightedge 41 is transferred into its perpendicular position by activating the pneumatic cylinders 43, whereupon the individual blocks are again aligned. A transverse channel 67 is now formed between the first straightedge 41 and the second straightedge 48, through which transverse channel 67 the individual blocks can be pushed out to a further-processing station after the ejector 53 is lowered. At any rate, an intermediate cut can be made during this push-out operation, and the next main cut is then made after the gap 25 is closed.

For the sake of simplicity, parts shown in FIGS. 11 to 14 concerning the second embodiment of the invention, which parts correspond to such parts in the first embodiment according to FIGS. 1 to 10, are designated below with the same reference numerals insofar as construction and mode of operation correspond, and also for the sake of simplicity the description of the said parts in the case of the second embodiment is dispensed with and in this respect reference is made to the explanations concerning FIGS. 1 to 10.

As apparent from the representation in FIG. 11, the horizontally movable table part 16 has a projection 68 in its end area remote from the cutting plane, which projection 68 extends upwards and has two pneumatic cylinders 26 at a distance from one another on its side facing the cutting plane. Their vertically extendable piston rods 28 act on the underside of a plate-shaped, horizontally oriented support 69 into which the table plate 29 to which the second zonal area 32 of the exit zone is allocated can be inserted via insertion elements (not shown). A vertically arranged strut 70 extending across the width of the table plate 29 connects the underside of the support 69 to the end of the table plate 35 remote from the cutting plane, which table plate 35 is arranged parallel to the table plate 29. The table plate 35 serves solely as a mounting part for the first straightedge 41; unlike the embodiment described above, it therefore does not contain any third zonal area 36 of the exit zone and, with its front edge facing the cutting plane, also ends quite definitely at a larger distance from the facing edge of the table plate 21, which is allocated to the first zonal area 22 of the exit zone.

The means of removing the table plate 29 from the support 69 serves the purpose of enabling the operator to check the cutting sequence without hindrance when the first straightedge 41 is at the working height. The table plate 29 will thus always be removed when block-like sets are to be cut and fed to a further-processing station over a longer period while using the first straightedge 41.

An infeed cylinder 71 can be moved in the feed direction and in the opposite direction on the table plate 35 in a manner still to be described in more detail. The piston rod 72 of the infeed cylinder 71 is positioned at a slight distance from the surface of the table plate 35 and, with its free end facing the cutting plane, pivotably accommodates the bottom end of the first straightedge 41.

Mounted at the top on the infeed cylinder 71 is the pneumatic cylinder 43, whose piston rod 44 acts pivotably on the first straightedge 41 at a distance from the pivoting point of the same.

When the piston rods 28 of the pneumatic cylinders 26 are extended, the support 69 carrying the table plate 29 lifts via the strut 70 the table plate 35 and the infeed cylinder 71, located on the table plate 35, plus the pneumatic cylinder 43 and the first straightedge 41. Lateral guides (not shown in more detail) for the table plate 35 and the support 69 ensure the exact lifting movement of the second table part 73 formed essentially by the support 69 having the table plate 29, the strut 70 and the table plate 35. As particularly apparent from the representation of the lifted position of the table part 73 according to the representation in FIGS. 13 and 14, the infeed cylinder 71 is connected via vertical guides 74 to a format-adjusting slide 75 which can be moved in the feed direction and in the opposite direction by means of two feed spindles 76 arranged parallel to one another. The format-adjusting slide 75 is guided in the horizontally extending area of the table part 16, and the feed spindles 76 driving it are connected to a drive 40 which is mounted in the perpendicular area of the table part 16. When the table part 35 is lifted, the vertical guides 74 firmly connected to the infeed cylinder 71 move relatively in the allocated guide surfaces of the format-adjusting slide 75. In the lifted position of the table plate 35, the infeed cylinder 71 can then be moved in the opposite direction to the feed direction by an appropriate displacement of the format-adjusting slide 75, whereupon a defined format of the set can be predetermined between the first straightedge 41 and the second straightedge 48, which is likewise pivotable. In detail, the table plate 35 is provided with elongated holes (not shown more specifically) which extend in the feed direction and through which the plate-shaped vertical guides 74 oriented in the feed direction pass and which therefore ensure that the infeed cylinder 71 is not only moved via these vertical guides 74 but is also guided on the table plate 35.

FIG. 11 shows the apparatus when table plate 29 is lowered, the exit zone being composed there of the first zonal area 22 allocated to the table plate 21, the second zonal area 32 allocated to the table plate 29 as well as a further zonal area 78 which adjoins the second zonal area 32 and represents the upper limit of the projection 68 of the first table part 16. FIG. 11 shows the apparatus in this fundamental arrangement of the exit zone following a main cut, and FIG. 12 shows the apparatus when the gap is open and the second straightedge 48 is extended, which has pushed the cut set completely onto the first zonal area 22 of the exit zone. The set can be both block strips and blocks. In the representation in FIGS. 13 and 14 it is also to be assumed that blocks are already located on the table plate 21. The table part 73 is then extended by means of the pneumatic cylinders 26 when the format-adjusting slide 75 is moved back, that is, when it is moved in the feed direction, the first straightedge 41 being positioned with its bottom end at a slight distance from the plane of the first zonal area 22 of the exit zone. The format-adjusting slide 75 is then moved in the direction of the cutting plane in accordance with the format of the blocks to be cut. In accordance with the representation in FIG. 7, the situation shown in FIG. 13 results after the cut, in which situation the individual blocks are displaced within themselves in a parallelogram shape and are supported by the first straightedge 41 when infeed cylinders 71 are retracted. The second straightedge 48 is then extended after the first table part 16 is moved horizontally in the feed direction, and before the cut material is pushed across by the second straightedge 48, the format-adjusting slide 75 is moved away from the material by an amount corresponding to this push-across movement. After the first straightedge 41 is swung into its vertical position by means of the pneumatic cylinders 43 and the ejector 53 is lowered behind the blocks, the situation shown in FIG. 14 before ejection of the blocks results.

List of reference numerals

1 Base
2 Table surface
3 Working zone
4 Entry zone
5 Material to be cut
5' Cut material
6 Feed device
7 Fixed stop
8 Frame part
9 Press beam
10 Cutting blade
11 Cutting strip
12 Front edge
13 Cutting plane
14 Supporting member
15 Guide rail
16 Table part
17 Pneumatic cylinder
18 Cylinder housing
19 Piston rod
20 Mounting web
21 Table plate
22 First zonal area of the exit zone
23 Front end
24 Rear end
25 Gap
26 Pneumatic cylinder
27 Cylinder housing
28 Piston rod
29 Table plate
30 Centre longitudinal axis
31 Recess
32 Second zonal area of the exit zone
33 Rear end
34 Connecting plate
35 Table plate
36 Third zonal area of the exit zone
37 Rear end
38 Toothed rack
39 Mounting
40 Drive
41 First straightedge
42 Pivot axis
43 Pneumatic cylinder
44 Piston rod
45 Cylinder housing
46 Pneumatic cylinder
47 Piston rod
48 Second straightedge
49 Top edge
50 Pneumatic cylinder
51 Piston rod
52 Mounting web
53 Ejector
54 Cylinder housing
55 Mounting element
56 Horizontal guide
57 Supporting bar
58 Supporting bar
59 Light-barrier arrangement
60 Lay straightedge
61 Scissor-type device
62 Pneumatic cylinder
63 Front face
64 Supporting element
65 Spring
66 Recessed portion
67 Transverse channel
68 Projection
69 Support
70 Strut
71 Infeed cylinder
72 Piston rod
73 Table part
74 Vertical guide
75 Format-adjusting slide
76 Feed spindle
78 Zonal area

I claim:

1. An apparatus for cutting stacked sheet-like material comprising:

a) a stationary base which forms a table having a first table surface upon which said material may be laid, said first table surface having:

1) an entry area where material to be cut enters the first table surface, and 2) a working area where the material is cut, b) a cutting blade and a press beam located above the working area, said cutting blade being operatively arranged to cut material in the working area of the first table surface, c) a feed device for advancing material from the entry area to the working area in the direction of the cutting blade, d) a movable table part which is movable relative to the stationary base, e) a first table plate mounted by means of supporting members to said stationary base, said first table plate being movable relative to said first table surface of the stationary base to form a gap between said first table surface and said first table plate, said first table plate having a second surface comprising a first part of an exit area for the material after it is cut, f) a second table plate mounted to said movable table part, said second table plate having a third surface which comprises a second part of said exit area, said second table plate operatively arranged to move in a vertical direction both toward and away from said first table plate and capable of being moved into a position such that said third surface is in the same plane as said second surface, g) a third table plate mounted to and underneath said first table plate by means of connecting plates, said third table plate having a surface, h) a first straightedge mounted on and transversely to said third table plate, i) a second straightedge mounted to said stationary base and operatively arranged to move in a vertical direction when said gap is formed so as to be in a position between said first surface and said first table plate, wherein said first and second straight edges form a transverse channel, and j) an ejector movable along the transverse channel and located above the first table plate when said gap is opened to its maximum, and operatively arranged to feed cut material to further processing stations.

2. Apparatus according to claim 1 characterized in that said third table plate is arranged parallel to and beneath said second table plate, the first straight edge being mounted to the third table plate between the third table plate and the second table plate and further characterized in that the second table plate and the third table plate are connected together so as to be liftable and lowerable together.

3. Apparatus according to claim 2 characterized in that the transverse channel is located above the plane of the first table plate and is bounded by said first straightedge which is movable parallel to the plane of the second table plate, said second straightedge which is not movable parallel to the plane of the second table plate and by the first table plate, wherein the width of the transverse channel may vary as the first straightedge moves, and may increase to as large as the width of the first table plate.

4. Apparatus according to claim 3 characterized in that said movable table part comprises:

a) a first table part mounted on said base so as to be movable horizontally in the feed direction of the material to be cut and in the opposite direction said first table part comprising the first table plate, and b) a second table part comprising the second table plate and being mounted to the first table part so as to be liftable and lowerable so that when said second table part is lowered the second table plate is level with the first table plate and when the second table part is lifted, said third table plate is level with the first table plate.

5. Apparatus according to claim 2 characterized in that said movable table part comprises:

a) a first table part mounted on said base so as to be movable horizontally in the feed direction of the material to be cut and in the opposite direction said first table part comprising the first table plate, and b) a second table part comprising the second table plate and being mounted to the first table part so as to be liftable and lowerable so that when said second table part is lowered the second table plate is level with the first table plate and when the second table part is lifted, the surface of said third table plate is level with the first table plate.

6. Apparatus according to claim 2 characterized in that the second table plate is separated from the third table plate by a distance which is greater than the maximum stack thickness of the cut material.

7. Apparatus according to claim 6 characterized in that said movable table part comprises:

a) a first table part mounted on said base so as to be movable horizontally in the feed direction of the material to be cut and in the opposite direction said first table part comprising the first table plate, and b) a second table part comprising the second table plate and being mounted to the first table part so as to be liftable and lowerable so that when said second table part is lowered the second table plate is level with the first table plate and when the second table part is lifted, said third table plate is level with the first table plate.

8. Apparatus according to claim 7 characterized in that lifting members are provided for lifting and lowering the second table par, said lifting members acting between the first table part and a support for the second table plate, and vertical guides are provided for guiding the motion of the second table part.

9. Apparatus according to claim 8 characterized in that the first straightedge is movable in the feed direction of the material to be cut and in the opposite direction.

10. Apparatus according to claim 9 characterized in that the first straightedge is movable between an end position at a rear edge of the first table plate to an end position at a rear edge of the third table plate.

11. Apparatus according to claim 10 characterized in that the first straightedge is pivotable between two working positions wherein it is inclined in a first position essentially in accordance with a bevel of the cutting blade and in a second position is essentially perpendicular to the third table plate.

12. Apparatus according to claim 11, characterized in that the surface of the third table plate defines a third plate of the exit area, the surface of the third table plate further defining a plane which is parallel to the surface of the second table plate and the third table plate being operatively arranged to be lifted so that the planes of the third table plate and first table plate coincide.

13. Apparatus according to claim 12 characterized in that the second straightedge is arranged in its inoperative position below the first table plate and is operatively arranged to be moved through the gap formed between the first table surface of the stationary base and the first table plate into a working position in which the second straight edge extends along the length of and against the first table plate and is essentially perpendicular to the first table plate.

14. Apparatus according to claim 13 characterized by a movable support element which is movably secured to the second straightedge, said movable support element being positionable to support material previously cut which projects beyond the rear edge of the first table plate, to at least the level of the second surface of the first table plate, the support element being moved into an opening in the second straight edge when the working position of the second straightedge has been reached.

15. Apparatus according to claim 14 characterized in that the movable supporting element has a top free end for supporting said previously cut material, said top free end being swung out from said second straight edge to support said previously cut material at the level of the surface of the second table plate, as said second straight edge is moved upwardly through said gap.

16. Apparatus according to claim 15 characterized in that the second straightedge, on a surface facing the material to be cut, accommodates a lay straightedge which is operatively arranged to be placed against a surface of the material to be cut.

17. Apparatus according to claim 16 characterized in that the lay straightedge is operatively arranged to be placed against a stack of sheet material to be cut in at least the area of the top sheets of the stack.

18. Apparatus according to claim 17 characterized in that the lay straightedge is mounted to the second straightedge by means of a plurality of scissor-type devices.

19. Apparatus according to claim 16 characterized in that the lay straightedge is mounted to the second straightedge by means of a plurality of scissor-type devices.

20. Apparatus according to claim 1 characterized in that said movable table part comprises:

a) a first table part mounted on said base so as to be movable horizontally in the feed direction of the material to be cut and in the opposite direction, said first table part comprising the first table plate, and b) a second table part comprising the second table plate and being mounted to the first table part so as to be liftable and lowerable so that when said second table part is lowered the second table plate is level with the first table plate and when the second table part is lifted, said third table plate is level with the first table plate.

21. Apparatus according to claim 20 characterized in that lifting members are provided for lifting and lowering the second table part, said lifting members acting between the first table part and a support for the second table plate, and vertical guides are provided for guiding the motion of the second table part.

22. Apparatus according to claim 1 characterized in that the first straightedge is movable in the feed direction of the material to be cut and in the opposite direction.

23. Apparatus according to claim 22 characterized in that the first straightedge is movable between an end position at a rear edge of the first table plate to an end position at a rear edge of the third table plate.

24. Apparatus according to claim 23, characterized in that the surface of the third table plate defines a third part of the exit area, the surface of the third table plate further defining a plane which is parallel to the surface of the second table plate and the third table plate being operatively arranged to be lifted so that the planes of the third table plate and first table plate coincide.

25. Apparatus according to claim 1 characterized in that the first straightedge is pivotable between two working positions wherein it is inclined in a first position essentially in accordance with a bevel of the cutting blade and in a second position is essentially perpendicular to the third table plate.

26. Apparatus according to claim 1 characterized in that the second straightedge is arranged in its inoperative position below the first table plate and is operatively arranged to be moved through the gap formed between the first table surface of the stationary base and the first table plate into a working position in which the second straight edge extends along the length of and against the first table plate and is essentially perpendicular to the first table plate.

27. Apparatus according to claim 26 characterized by a movable support element which is movably secured to the second straightedge, said movable support element being positionable to support material previously cut which projects beyond the rear edge of the first table plate, to at least the level of the second surface of the first table plate, the support element being moved into an opening in the second straight edge when the working position of the second straightedge has been reached.

28. Apparatus according to claim 27 characterized in that the movable supporting element has a top free end for supporting said previously cut material, said top free end being swung out from said second straight edge to support said previously cut material at the level of the surface of the second table plate, as said second straight edge is moved upwardly through said gap.

29. Apparatus according to claim 1 characterized in that the second straightedge, on a surface facing the material to be cut, accommodates a lay straightedge which is operatively arranged to be placed against a surface of the material to be cut.

30. Apparatus according to claim 29 characterized in that the lay straightedge is operatively arranged to be placed against a stack of sheet material to be cut in at least the area of the top sheets of the stack.

31. Apparatus according to claim 30 characterized in that the lay straightedge is mounted to the second straightedge by means of a plurality of scissor-type devices.

32. Apparatus according to claim 29 characterized in that the lay straightedge is mounted to the second straightedge by means of a plurality of scissor-type devices.

* * * * *